US005273951A

United States Patent [19]

Defieuw et al.

[11] Patent Number: 5,273,951

[45] Date of Patent: Dec. 28, 1993

[54] DYE-DONOR ELEMENT FOR USE ACCORDING TO THERMAL DYE SUBLIMATION TRANSFER

[75] Inventors: Geert H. Defieuw, Kessel-Lo; Daniël M. Timmerman, Mortsel, both of Belgium; Harald Blum, Wachtendonk, Fed. Rep. of Germany

[73] Assignee: Agfa-Gevaert, N.V., Mortsel, Belgium

[21] Appl. No.: 899,855

[22] Filed: Jun. 17, 1992

[30] Foreign Application Priority Data

Aug. 16, 1991 [EP] European Pat. Off. ..... 91202098.9

[51] Int. Cl.[5] ..... B41M 5/035; B41M 5/38

[52] U.S. Cl. ..... 503/227; 428/195; 428/447; 428/913; 428/914

[58] Field of Search ..... 503/227; 428/195, 447, 428/913, 914

[56] References Cited

U.S. PATENT DOCUMENTS 4,738,950 4/1988 Vanier et al. ..... 428/195

*Primary Examiner*—Pamela R. Schwartz

*Attorney, Agent, or Firm*—Breiner & Breiner

[57] ABSTRACT

Dye-donor element for use according to thermal dye sublimation transfer comprising a support having on one side a dye layer and on the other side a slipping layer, characterized in that said slipping layer comprises the cured product of a moisture-curable binder composition prepared by mixing the following components (A) and (B):

(A)30 to 99 parts by weight of at least one copolymer of olefinically unsaturated compounds having a weight-average molecular weight [Mw] of at least 1500 and containing chemically incorporated moieties capable of undergoing an addition reaction with amino groups, and (B)1 to 70 parts by weight of organic substances containing blocked amino groups from which substances under the influence of moisture compounds having free primary and/or secondary amino groups are formed, wherein i) the copolymers of component (A) contain intramolecularly bound carboxylic anhydride moieties, with the anhydride equivalent weight of the copolymers being from 196 to 9800 and ii) the binder composition contains from 0.25 to 10 anhydride moieties for each blocked amino group.

12 Claims, No Drawings

DYE-DONOR ELEMENT FOR USE ACCORDING TO THERMAL DYE SUBLIMATION TRANSFER

1. FIELD OF THE INVENTION

The present invention relates to dye-donor elements for use according to thermal dye sublimation transfer and in particular to a slipping layer of said dye-donor element.

2. BACKGROUND OF THE INVENTION

Thermal dye sublimation transfer also called thermal dye diffusion transfer is a recording method in which a dye-donor element provided with a dye layer containing sublimable dyes having heat transferability is brought into contact with a receiver sheet and selectively, in accordance with a pattern information signal, heated with a thermal printing head provided with a plurality of juxtaposed heat-generating resistors, whereby dye from the selectively heated regions of the dye-donor element is transferred to the receiver sheet and forms a pattern thereon, the shape and density of which is in accordance with the pattern and intensity of heat applied to the dye-donor element.

A dye-donor element for use according to thermal dye sublimation transfer usually comprises a very thin support e.g. a polyester support, one side of which is covered with a dye layer, which contains the printing dyes. Usually an adhesive or subbing layer is provided between the support and the dye layer.

Due to the fact that the thin support softens when heated during the printing operation and then sticks to the thermal printing head thereby causing malfunctioning of the printing apparatus and reduction in image quality the backside of the support (side opposite to the dye layer) is typically provided with a slipping layer to facilitate passage of the dye-donor element under the thermal printing head. An adhesive layer may be provided between the support and the slipping layer.

The slipping layer generally comprises a lubricating material and a binder. In the conventional slipping layers the binder is either a cured binder (radiation- or heat-cured) or a polymeric thermoplast.

Using polymeric thermoplasts as binder for the slipping layer such as i.a. poly(styrene-co-acrylonitrile), polystyrene and polymethylmethacrylate has the disadvantage of relatively low heat stability of the slipping layer containing said binder en therefore unsatisfactory performance of said slipping layer. Further when dye-donor elements having such slipping layers have been rolled up and stored for any length of time such that the backcoat of one portion of the donor element is held against the dyecoat of another portion, sticking of the backcoat to the dyecoat occurs and migration of the dye takes place leading to a loss of density of any prints eventually made using that donor element.

A disadvantage of using radiation-cured binders for the slipping layer (as described in, for example, EP 329117, JP 60/151096, JP 60/229787, JP 60/229792, JP 60/229795, JP 62/212192 and JP 02/128899) is their cumbersome manufacture.

The actually used cross-linking agent in the heat-curable binder systems for the slipping layer (as described in, for example, EP 153880, EP 194106, EP 324946, JP 62/227787, JP 62/259889, JP 63/51189, JP 01/5884 and JP 01/51980) is a polyisocyanate, which is highly toxic and therefore is to be avoided. A further problem encountered upon using polyisocyanate heat-curable binder systems is the limited pot life of the binder composition.

3. SUMMARY OF THE INVENTION

It is an object of the present invention to provide slipping layers not having the disadvantages mentioned above.

According to the present invention a dye-donor element for use according to thermal dye sublimation transfer is provided, said dye-donor element comprising a support having on one side a dye layer and on the other side a slipping layer, characterized in that said slipping layer comprises the cured product of a moisture-curable binder composition prepared by mixing the following components (A) and (B):

(A) 30 to 99 parts by weight of at least one copolymer of olefinically unsaturated compounds having a weight-average molecular weight [Mw] of at least 1500 and containing chemically incorporated moieties capable of undergoing an addition reaction with amino groups, and (B) 1 to 70 parts by weight of organic substances containing blocked amino groups from which substances under the influence of moisture compounds having free primary and/or secondary amino groups are formed, wherein i) the copolymers of component (A) contain intramolecularly bound carboxylic anhydride moieties, with the anhydride equivalent weight of the copolymers being from 196 to 9800 and ii) the binder composition contains from 0.25 to 10 anhydride moieties for each blocked amino group.

The binder product obtained in curing the above-defined binder composition with the aid of water (moisture) results from the hydrolysis of the blocked amino moieties of component (B), whereby one hydroxyl group is formed per amino group (primary or secondary amino group). These groups, especially said amino groups, enter into rapid cross-linking reaction with the anhydride groups of copolymer (A).

Using the binder composition according to the present invention yield slipping layers that are excellent in performance and that do not stick to the dye layer during storage of the donor element in rolled form. Further the manufacture of said slipping layers proceeds in a very convenient and rapid manner.

4. DETAILED DESCRIPTION OF THE INVENTION

According to a preferred embodiment, the binder composition used according to the present invention is obtained by mixing:

(A) 50 to 97 parts by weight of (a) copolymer(s) of maleic anhydride with at least one other olefinically unsaturated monomer, said copolymer containing addition polymerized maleic anhydride units and having a weight-average molecular weight (Mw) of 1500 to 75000, and (B) 3 to 50 parts by weight of at least one organic substance containing blocked amino groups and having a molecular weight of 86 to 10000, wherein component (A) consists essentially of a copolymer of:

a) 3 to 25 parts by weight of maleic anhydride, and b) 75 to 97 parts by weight of at least one copolymerisable monomer selected from the group corresponding to the following general formulae (I), (II) and (III):

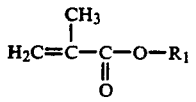

(I)

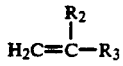

(II)

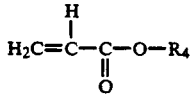

(III)

wherein:

each of $R_1$ and $R_4$ independently of each other represents an aliphatic or cycloaliphatic $C_1$–$C_{22}$ hydrocarbon group in which one or more carbon atoms may be replaced by heteroatoms selected from the group consisting of oxygen, sulphur and nitrogen; a fluoroalkyl group; a perfluoroalkyl group or a polydialkylsiloxane group;

$R_2$ represents hydrogen, methyl, ethyl, chlorine, fluorine or an alkoxy group;

$R_3$ represents a $C_2$–$C_{22}$ aliphatic hydrocarbon group; a $C_5$–$C_{10}$ cycloaliphatic hydrocarbon group; a $C_6$–$C_{12}$ aromatic hydrocarbon group (including an aryl aliphatic group) and in each of these three hydrocarbon groups (aliphatic, cycloaliphatic and aromatic) possibly one or more carbon atoms may be replaced by heteroatoms selected from the group consisting of oxygen, sulphur and nitrogen in the form of ether, ester, amide, urethane, urea, thioester, oxirane, ketone, lactam or lactone group; a fluoroalkyl group; a perfluoroalkyl group; a polydialkylsiloxane group; a nitrile group; chlorine; and wherein component (B) is a compound selected from the group consisting of an aldimine, ketimine, oxazolane, hexahydropyrimidine, tetrahydropyrimidine, tetrahydroimidazole, amidacetale and amidaminale.

Examples of copolymerisable monomers corresponding to formulae (I), (II) or (III) are: methyl(meth)acrylate, ethyl(meth)acrylate, propyl(meth)acrylate, butyl(meth)acrylate, 2-ethylhexyl(meth)acrylate, lauryl(meth)acrylate, hexadecyl(meth)acrylate, stearyl(meth)acrylate, glycidyl(meth)acrylate, hexanediol bisacrylate, (meth)acrylonitrile, butadiene, isoprene, styrene, α-methylstyrene, methoxystyrene, vinyltoluene, vinylacetate, vinylpropionate, vinylbutyrate, vinyllaurate, vinylpalmitate, vinylstearate, vinyleicosate, vinyldocosate, vinylchloride, vinylidenechloride, vinylpyridine, N-vinylpyrrolidone, vinylnaphthalene, vinylpyridine, triethyleneglycol monomethylether mono(meth)acrylate, heptadecafluorodecyl(meth)acrylate and polydimethylsiloxane mono(meth)acrylate.

Depending on the nature of the copolymerisable monomers and their weight ratio in the copolymer (A) the properties of the layer containing the moisture-cured binder according to the present invention can be influenced. Thus incorporating monomers such as butylacrylate and 2-ethylhexylacrylate in the copolymer (A) will improve the filmforming properties of the copolymer (A); incorporating monomers such as vinylstearate or stearylmethacrylate or polydimethylsiloxane monoacrylate will improve the lubricating properties of the layer. There can also be incorporated in the copolymer (A) monomers that improve the heat stability of the layer.

According to a particular embodiment the copolymer containing anhydride groups contains additionally epoxide groups as described in U.S. Pat. No. 4,904,740, wherein the last mentioned groups also take part in a crosslinking reaction with free amino groups.

Preferred maleic anhydride copolymers (A) have a weight-average molecular weight [Mw] determined by gel chromatography of 3000 to 50000. Their anhydride equivalent weight (=quantity in gram containing 1 mole of anhydride groups) is from 3800 to 393 and preferably from 2000 to 450.

They are produced in known manner by radically initiated copolymerisation, preferably in the presence of organic solvents. Suitable solvents for that purpose are given in U.S. Pat. No. 4,975,493 which also mentions detailed preparation examples of such copolymers. The radical formers applied in the copolymerisation process are those suitable for reaction temperatures of 60° to 180° C. such as organic peroxides and other radical formers mentioned in U.S. Pat. No. 4,975,493.

Preferred maleic anhydride copolymers for use according to the present invention contain styrene, methacrylate and/or acrylate units.

Preferably used blocked amines are oxazolanes, e.g. those described in said U.S. Pat. No. 4,975,493. Blocked amines containing aldimine or ketimine groups for generating free amino groups with water are described in U.S. Pat. No. 4,937,293. Blocked amines containing hexahydropyrimidine or tetrahydropyrimidine or tetrahydroimidazole moieties for generating free amino groups are described in U.S. Pat. No. 4,970,270. Blocked amines being amidacetale or amidaminale compounds are described in EP 346669.

The blocked amines representing said component (B) have preferably a molecular weight of from 86 to 10000, preferably from 250 to 4000 and contain a statistical average of from 1 to 50, preferably 1 to 10, especially 2 to 4 structural units corresponding to at least one of the following general formulae (IV), (V), (VI), (VII) and (VIII):

IV

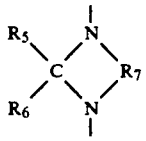

V

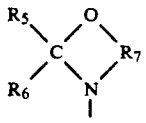

VI

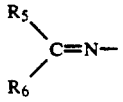

VII

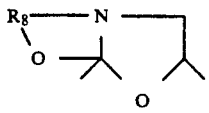

-continued

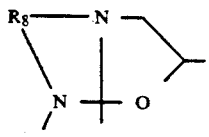

VIII wherein:

each of $R_5$ and $R_6$ independently of each other represents hydrogen, an aliphatic hydrocarbon group containing from 1 to 18 carbon atoms, a cycloaliphatic hydrocarbon group containing from 5 to 10 carbon atoms, an araliphatic hydrocarbon group containing from 7 to 18 carbon atoms or a phenyl group, or $R_5$ and $R_6$ represent together the necessary atoms to form a five- or six- membered cycloaliphatic ring with the carbon atom whereto they are commonly linked;

$R_7$ represents a divalent aliphatic hydrocarbon group containing 2 to 6 carbon atoms, but having only a chain of 2 to 3 carbon atoms between the defined heteroatoms of the ring;

$R_8$ represents a divalent aliphatic hydrocarbon group having 2 to 10 carbon atoms, but having only 2 or 3 carbon atoms between the heteroatoms whereto said group is linked.

Preparation examples of compounds within the scope of said general formulae are given in U.S. Pat. No. 4,975,493, U.S. Pat. No. 4,937,293, U.S. Pat. No. 4,970,270, and in EP 346669.

Suitable aldehydes or ketones for the preparation of the compounds B) containing hexahydropyrimidine or tetrahydropyrimidine or tetrahydroimidazole groups (formula IV) are, e.g. those corresponding to the following general formula:

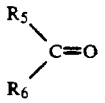

wherein $R_5$ and $R_6$ have the same meaning as described above, and preferably having a molecular weight of from 72 to 200 for the ketones, and from 58 to 250 for the aldehydes.

The following are examples of these compounds: methyl ethyl ketone, methyl propyl ketone, methyl isopropyl ketone, methyl-n-butyl ketone, methyl-n-amyl ketone, diethyl ketone, cyclohexanone, methyl-tert.-butyl ketone, 3,3,5-trimethyl-cyclohexanone, isobutyraldehyde, 2,2-dimethylpropanal, 2-ethylhexanal, hexanal, octanal, hexahydrobenzaldehyde.

The polyamines used for the preparation of the compounds containing hexahydropyrimidine or tetrahydropyrimidine or tetrahydroimidazole groups are in particular organic compounds containing at least 2 primary and/or secondary amino groups.

Suitable polyamines are, e.g. those corresponding to the following general formula:

$$R_9—NH—R_7—NH—R_{10}$$

in which $R_7$ has the meaning indicated above, and each of $R_9$ and $R_{10}$ (same or different) denote hydrogen, aliphatic hydrocarbon groups containing 1 to 10, preferably 1 to 4 carbon atoms, cycloaliphatic hydrocarbon groups containing 5 to 10, preferably 6 carbon atoms or aromatic hydrocarbon groups containing 7 to 15, preferably 7 carbon atoms, and the above-mentioned hydrocarbon groups, in particular the aliphatic hydrocarbon groups, may contain heteroatoms such as oxygen, nitrogen or sulphur in the form of ether, ester, amide, urethane, oxirane, ketone, lactam, urea, thioether, thioester or lactone groups, and may also contain reactive hydroxyl or amino groups.

Particularly preferred polyamines are those in which $R_9$ and $R_{10}$ (identical or different) stand for an alkyl group such as methyl, ethyl, n-propyl, isopropyl, n-butyl, isobutyl, tert.-butyl, n-pentyl or n-hexyl and at least one of the groups denoted by $R_9$ and $R_{10}$ is a group obtainable by the addition of an amine hydrogen atom to an olefinically unsatured compound. Examples of olefinically unsaturated compounds suitable for the preparation of such modified polyamines include derivatives of (methyl)acrylic acid such as the esters, amides or nitriles thereof or, e.g. aromatic vinyl compounds such as styrene, α-methylstyrene or vinyl toluene or, e.g. vinyl esters such as vinyl acetate, vinyl propionate or vinyl butyrate or, for example, vinyl ethers such as ethyl vinyl ether, propyl vinyl ether, butyl vinyl ether or mono- or diesters for fumaric acid, maleic acid or tetrahydrophthalic acid.

$R_9$ and/or $R_{10}$ may also stand for an aminoalkyl or hydroxyalkyl group containing, e.g. 2 to 4 carbon atoms.

Ethylene diamine, 1,2-propylene diamine, 1,3-propylene diamine, 1,2- and 1,3-butylene diamine and diethylene triamine are particularly useful.

Compounds B) containing aldimine or ketimine groups (formula VI) in principle may be prepared from the aldehydes or ketones already mentioned above as examples. Preferred aldehydes and ketones used for this purpose include isobutyraldehyde, 2,2-dimethylpropanal, 2-ethylhexanal, hexahydrobenzaldehyde and especially those ketones which have a boiling point below 170° C. and are readily volatile at room temperature, e.g. methyl isobutyl ketone, methyl isopropyl ketone, diethyl ketone, diisobutyl ketone and methyl tert.-butyl ketone.

The polyamines used for the preparation of component B) containing ketimine or aldimine groups may in particular be organic compounds containing at least 2 aliphatically and/or cycloaliphatically bound primary amino groups. Although polyamines containing aromatically bound amino groups may also be used, they are less preferred. The polyamines generally have a molecular weight of from 60 to 500, preferably from 88 to 400, although prepolymers with a relatively high molecular weight containing amino end groups may also be used as polyamine components for the preparation of component B).

Diprimary aliphatic and cycloaliphatic diamines are particularly preferred polyamines, e.g. tetramethylene diamine, hexamethylene diamine, isophorone diamine, bis(4-amino-cyclohexyl)-methane, bis-aminomethylhexahydro-4,7-methanoindane, 1,4-cyclohexanediamine, 1,3-cyclohexane diamine, 2-methylcyclohexane diamine, 4-methylcyclohexane diamine, 2,2,5-trimethylhexane diamine, 2,2,4-trimethylhexane diamine, 1,4-butane diol-bis(3-aminpropyl)-ether, 2,5-diamine-2,5-dimethylhexane, bis-aminomethylcyclohexane, bis(4-amino-3,5-dimethylcyclohexyl)-methane and mixtures thereof.

Tetramethylene diamine, hexamethylene diamine, isophorone diamine, bis-aminomethyl-cyclohexane, 1,4-cyclohexane diamine, bis-aminomethylhexahydro-4,7-methanoindane and bis(4-amino-cyclohexyl)-methane are particularly preferred.

The aldimines and ketimines may be prepared not only from these preferred diamines but also from prepolymers containing primary amino end groups, i.e. compounds in the molecular weight range of from 500 to 5000, preferably from 500 to 2000, containing at least two amino end groups. These groups include, e.g. the amino polyethers known from polyurethane chemistry, such as these described, e.g. in EP 81701 or, e.g., compounds containing amide, urea, urethane or secondary amino groups obtained as reaction products of difunctional or higher functional carboxylic acids, isocyanates or epoxides with diamines of the type exemplified above, which reaction products still contain at least two primary amino groups. Mixtures of such relatively high molecular weight polyamines with the low molecular weight polyamines exemplified above may also be used.

The aromatic polyamines which in principle may be used for the preparation of the aldimines or ketimines but are less preferred include, e.g. 2,4- and 2,6-diaminotoluene, 1,4-diaminobenzene and 4,4'-diaminodiphenylmethane.

The compound (B) containing bicyclic amide acetal groups (formula VII) can be obtained in a manner known per se by reaction of compounds containing epoxy or cyclic carbonate groups with cyclic amino esters such as, for example, oxazolines or oxazines. Preferably, the starting components in this reaction are used in such relative amounts that a total of 1.0 to 1.1 oxazoline or oxazine groups is present for every epoxy or cyclic carbonate group. This type of reactions, which lead to compounds having bicyclic amide acetal groups, are described in detail, e.g. in R. Feinauer, Liebigs Ann. Chem. 698, 174 (1966).

The oxazolines or oxazines which are used for the preparation of the bicyclic amide acetals can be prepared by methods known from the literature, e.g. by reaction of carboxylic acids or anhydrides thereof with hydroxyamines with the elimination of water or by reaction of nitriles with hydroxyamines with the elimination of ammonia. This type of reactions is described, e.g. in J. Org. Chem. 26, 3821 (1961), H. L. Wehrmeister, J. Org. Chem. 27, 4418 (1962) and P. Allen, J. Org. Chem. 28, 2759 (1963).

Oxazolines or oxazines which contain hydroxyl groups can also be converted into higher-functional oxazolines or oxazines, e.g. by reaction with organic polyisocyanates.

Bicyclic amide aminals (formula VIII) which are suitable according to the invention as component B) can be obtained, e.g. by reaction of tetrahydropyrimidines or dihydroimidazoles with organic epoxides or cyclic carbonates.

In this reaction, monofunctional tetrahydropyrimidines or dihydroimidazoles can be reacted with monofunctional epoxides or carbonates, polyfunctional tetrahydropyrimidines or dihydroimidazoles with monofunctional epoxides or carbonates, monofunctional tetrahydropyrimidines or dihydroimidazoles with polyfunctional epoxides or carbonates.

The tetrahydropyrimidines or dihydroimidazoles used for the preparation of the bicyclic amide aminals can be prepared by methods known from the literature, e.g. by reaction of carboxylic acids with diamines with the elimination of water, or by reaction of nitriles with diamines with the elimination of ammonia. This type of reaction is described, e.g. in DE 3640239. For the preparation of polymeric dihydroimidazole compounds reference is made to GB 1221131.

Compounds containing oxazolane groups of the general formula V are especially preferred as component B).

Components B) containing oxazolane groups may be prepared in known manner by the reaction of the corresponding aldehydes or ketones corresponding to the following general formula ($R_5$ and $R_6$ having the meaning defined above):

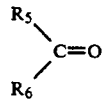

with suitable hydroxylamines of the type described hereinafter.

The aldehydes or ketones used may be selected from those already mentioned above as examples. Preferred aldehydes and ketones include isobutyraldehyde, 2-ethylhexanal, hexahydrobenzaldehyde, cyclopentanone, cyclohexanone, methylcyclohexanone, acetone, methyl ethyl ketone and methyl isobutyl ketone.

The hydroxylamines may be in particular organic compounds containing at least 1 aliphatic amino group and at least 1 aliphatically bound hydroxyl group. Although hydroxylamines containing aromatically or cycloaliphatically bound amino or hydroxyl groups may be used, they are less preferred. The hydroxylamines generally have a molecular weight of from 61 to 500, preferably from 61 to 300.

The following are examples of suitable hydroxylamines: bis(2-hydroxyethyl)-amine, bis(2-hydroxypropyl)-amine, bis(2-hydroxybutyl)-amine, bis(3-hydroxypropyl)-amine, bis(3-hydroxyhexyl)-amine, N-(2-hydroxypropyl)-N-(2-hydroxyethyl)-amine, 2-(methylamino)-ethanol, 2-(ethylamino)-ethanol, 2-(propylamino)-ethanol, 2-(butylamino)-ethanol, 2-(hexylamino)-ethanol, 2-(cyclohexylamino)-ethanol, 2-amino-2-methyl-1-propanol, 2-amino-2-ethyl-1-propanol, 2-amino-2-propyl-1-propanol, 2-amino-2-methyl-1,3-propanediol, 2-amino-3-methyl-3-hydroxybutane, propanolamine and ethanolamine.

The following are particularly preferred : bis(2-hydroxy-ethyl)-amine, bis(2-hydroxypropyl)-amine, bis(2-hydroxy-butyl)-amine, bis(3-hydroxyhexyl)-amine, 2-(methylamino)-ethanol, 2-(ethylamino)-ethanol, 2-amino-2-methyl-1-propanol, 2-amino-2-ethyl-1-propanol, propanolamine and ethanolamine.

When component (B) contains oxazolane groups it can be prepared by allowing to react the above-defined reactants in such quantitative ratios that based on the carbonyl groups of the aldehydes or ketones, the hydroxylamines are present in 1 to 1.5 times the equivalent quantity in the oxazolane formation. Catalytic quantities of acidic substances, e.g. p-toluene sulfonic acid, hydrogen chloride, sulfuric acid or aluminium chloride, may be used to accelerate the reaction. A suitable reaction temperature is in the range of 60° to 180° C., the water formed in the reaction being removed by distillation using an entraining agent as described in U.S. Pat. No. 4,975,493.

To produce components (B) having in their molecule a plurality of oxazolane moieties, mono-oxazolanes according to the above mentioned general formula (V) are allowed to react through hydrogen on their nitrogen atom with a polyfunctional reactant, e.g. polyisocyanate, polyepoxide, polycarboxylic acid, partially esterified polycarboxylic acid or polyacid anhydride. The reaction with organic polyisocyanates is preferred and may be carried out as described in DE 2446438.

Examples of polyisocyanates which are suitable for this modifying reaction are aliphatic, cycloaliphatic, araliphatic, aromatic or heterocyclic polyisocyanates, such as those described, e.g. by W. Siefken in Justus Liebigs Annalen de Chemie, 562, p. 75 to 136, e.g. 1,4-tetramethylene diisocyanate, 1,6-hexamethylene diisocyanate, 1,12-dodecane diisocyanate, cyclobutane 1,3-diisocyanate, cyclohexane 1,3-diisocyanate, cyclohexane 1,4-diisocyanate, 1-isocyanato-3,3,5-trimethyl-5-isocyanato-methylcyclohexane, 1,4- and 2,6-hexahydrotoluylene diisocyanate, hexahydro-1,3- and -1,4-phenylene diisocyanate, 1,3-phenylene diisocyanate, 1,4-phenylene disocyanate, diphenylmethane-2,4'- and/or 4,4'-diisocyanate, naphthylene 1,5-diisocyanate, mixtures of these and other polyisocyanates, polyisocyanates having carbodiimide groups (as described e.g. in DE 1092007), polyisocyanates having allophanate groups (as described e.g. in GB 994890), polyisocyanates having isocyanurate groups (as described e.g. in DE 1022789 and DE 1222067), polyisocyanates having urethane groups (as described e.g. in U.S. Pat. No. 3,394,164) or polyisocyanates prepared by reaction of at least one difunctional hydroxyl compound with excess of at least one difunctional isocyanate, polyisocyanates having biuret groups (as described e.g. in DE 1101394) and prepolymer or polymer substances having at least two isocyanate groups.

Examples of suitable polyisocyanate compounds are further given in the book High Polymers, Volume XVI dealing with "Polyurethanes, Chemistry and Technology", Interscience Publishers, New York, London, and further also in Volume I, 1962, p. 32–42 and 45–54 and Volume II, 1964, p. 5–6 and 198–199, and also in Kunststoffhandbuch (Handbook of Plastics), Volume VI, Vieweg-Höchtlen, Carl-Hanser Verlag, Munich, 1966, p. 45–71.

Particularly preferred polyisocyanates for preparing polyfunctional oxazolanes are low molecular weight (cyclo)aliphatic diisocyanates, e.g.: hexamethylene diisocyanate, isophorone diisocyanate, 4,4'-diisocyanatodicyclohexylmethane or relatively high molecular weight isocyanate prepolymers based on such diisocyanates.

According to a preferred embodiment in the formation of polyfunctional oxazolanes said preferred polyisocyanates are allowed to react with monoxazolanes according to the above-mentioned general formula (V) wherein nitrogen is linked to a $HO—CH_2—CH_2—$-group to form an urethane linkage, $R_5$ represents hydrogen, $R_6$ an ethyl-1-pentyl group, and $R_7$ is an ethylene group.

Polyepoxides suitable for use in the preparation of polyfunctional oxazolanes are organic compounds containing at least two epoxide groups.

Preferred polyepoxides for such use are aliphatic bisepoxides having epoxide equivalent weights of 43 to 300, e.g. 1,3-butadiene bisepoxide, 1,5-hexadiene bisepoxide, ethylene glycol diglycidyl ether, glycerol-1,3-diglycidyl ether, 3,4-epoxycyclohexyl, methyl-3',4'-epoxycyclohexane carboxylate, and adipic acid-(3,4-epoxycyclohexyl)-bisester.

Still other methods of preparing oxazolanes of relatively high functionality are described in the already mentioned U.S. Pat. No. 4,975,493.

The molecular weight and functionality of the oxazolanes of relatively high functionality may be adjusted readily through the choice of the reactants.

For use according to the present invention di- and/or trifunctional oxazolanes are applied preferably in conjunction with a copolymer of maleic anhydride and other monomers, e.g. styrene, methyl methacrylate and butyl acrylate, containing at least 10% by weight of polymerised maleic anhydride units.

The following illustrates in detail the preparation of specific components (A) and (B) suited for use according to the present invention.

I. Preparation of the Maleic Anhydride Copolymers A

General procedure for preparing the maleic anhydride copolymers $A_1$–$A_9$ mentioned in Table 1 under the heading MSA-copolymers A:

Part I is introduced initially into a reaction vessel equipped with a stirring, cooling and heating system, heated to the reaction temperature. Part II is added over a period of 3 hours and part III over a period of 3,5 hours, followed by stirring for 2 hours.

The reaction temperatures and the composition of parts I–III are shown in the following Table 1 together with the solids content and viscosity of the maleic anhydride copolymer solution obtained.

| | MSA-Copolymers A (Quantities in g) | | | | | | | | |
|---|---|---|---|---|---|---|---|---|---|
| | $A_1$ | $A_2$ | $A_3$ | $A_4$ | $A_5$ | $A_6$ | $A_7$ | $A_8$ | $A_9$ |
| Part I | | | | | | | | | |
| Butyl acetate | 1050 | 1534 | 1400 | | | 798 | 1670 | | 1500 |
| Methoxypropyl acetate | | | | 1200 | 800 | | | 1891 | |
| Xylene | | | | | | | 3300 | | |
| Part II | | | | | | | | | |
| Xylene | | | | | | | 1400 | | |
| Methyl methacrylate | 859 | 780 | 1025 | | 600 | 675 | 1080 | | 120 |
| Styrene | 313 | 180 | 341 | 450 | 30 | 350 | 3360 | 1013 | 870 |
| Bytyl acrylate | 300 | 300 | 732 | 675 | 327.5 | 1056 | 4560 | 563 | 1410 |
| Glycidyl methacrylate | | 120 | | | | | | | |
| Maleic anhydride | 284 | 120 | 244 | 375 | 40 | 425 | 2400 | 300 | 480 |
| Hexanediol bisacrylate | | | | | 2.5 | | | | |
| Butyl acetate | | | | | | 1275 | 1000 | | 449 |
| n-Dodecylmercaptan | | | | | 10 | | | | |
| Part III | | | | | | | | | |
| AIBN | | | | 30 | 20 | | | | |

-continued

| | MSA-Copolymers A (Quantities in g) | | | | | | | | |
|---|---|---|---|---|---|---|---|---|---|
| | $A_1$ | $A_2$ | $A_3$ | $A_4$ | $A_5$ | $A_6$ | $A_7$ | $A_8$ | $A_9$ |
| Ditert.butyl peroxide | | | | | | | 600 | | |
| tert.-butyl peroctoate (70%) | 105 | 86 | 140 | | | 105 | | 233 | 171 |
| Xylene | | | | | | | 600 | | |
| Methoxypropyl acetate | | | | 330 | 200 | | | | |
| Butyl acetate | 360 | | 118 | | | | | | |
| Reaction temperature (°C.) | 115 | 120 | 120 | 130 | 120 | 126 | 150 | 145 | 125 |
| Solids content (%) | 55.2 | 50.0 | 60.4 | 55.7 | 40.6 | 56.4 | 60.0 | 49.3 | 59.5 |
| Viscosity (mPa.s) | 11100 | 900 | | 18700 | 576 | 1100 | 1100 | | 2100 |
| Anhydride equivalent weight (g) (theory) | 606 | 1225 | 941 | 392 | 2450 | 578 | 465 | 613 | 588 |

II. Preparation of blocked polyamines B

B 1) The bisketimine B1 is obtained from 680 g of isophoronediamine, 1000 g of methyl isobutyl ketone and 560 g of toluene after separation of 146 g of water (theoretical quantity: 144 g) at 120° C. and subsequent distillation.

B 2) 200 g of isobutyraldehyde and 133 g of cyclohexane are introduced under nitrogen atmosphere into a 1 l reaction vessel equipped with stirring, cooling and heating means and the reaction mixture is cooled to 10° C. in an ice bath. Thereupon 176.6 g of 1-amino-3-(methylamino)-propane are slowly added dropwise and the reaction mixture is stirred at 10° C. for one hour. It is then heated to reflux temperature until 52 g of water have separated off. After removal of the solvent and unreacted blocking agent by distillation hexahydropyrimidine is obtained.

B 3) By transforming propionic anhydride and aminoethanol by refluxing in xylene under azeotropic elimination of the reaction water (H. L. Wehrmeister, J. Org. Chem., 26, 3821 (1961)) a monooxazoline as defined hereinafter by structural formula is obtained that is purified by distillation:

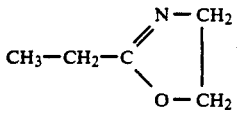

99 g of this monooxazoline, 88 g of ethylene carbonate and 0.4 g of lithium chloride are heated at 150° C. for 12 h. After distillation the colourless, bicyclic amidacetal B3 is obtained.

B 4) By transforming 528 g of 1-amino-3-methylaminopropane and 360 g of acetic acid in 99 g of toluene and elimination of the reaction water at 100° to 130° C. a tetrahydropyrimidine precursor is obtained (theor.: 216 g; found: 212.5 g), which after distillation is obtained in about 90% yield as a bright and colourless liquid. 112 g of tetrahydropyrimidine precursor are made to react in 200 g of butyl acetate with 87 g of ethylene glycol diglycidyl ether at 120 to 130° C. for 5 h. After adding charcoal the reaction mixture is stirred for still 1 h, and filtered off unter nitrogen atmosphere. A yellow solution (about 50%) of the difunctional bicyclic amidaminal B4 is obtained.

Preparation of the Oxazolanes B

General procedure:

To prepare the oxazolanes, the hydroxyamines, the carbonyl compounds and, optionally, the entraining agent are mixed and 0.01 to 0.1% of an acidic catalyst is added optionally to the resulting mixture. The reaction mixture is then heated under reflux in an inert gas atmosphere (e.g. $N_2$, Ar) on a water separator until the theoretical quantity of water has separated off or until no more water separates off. The products thus obtained may be used for the combinations according to the invention without any further purification or separation step. When the purity or uniformity of the products has to meet particularly exacting requirements, the products may be purified, e.g. by vacuum distillation.

B 5) The oxazolane B5 is obtained from 210 g of diethanolamine, 158.4 g of isobutyraldehyde and 92.1 g of xylene after separation of 34.2 g of water (theoretical quantity: 36 g).

B 6) 536 g of trimethylolpropane, 1368 g of ε-caprolactone, 476 g of dimethyldiglycol and 0,4 g of an esterification catalyst (tin dioctoate) are heated together to 140° C. for 4 h. Thereupon 297,5 g of the trimethylolpropane/ε-caprolactone adduct thus prepared and 265.0 g oxazolane B5 are heated together to 50° C. After the dropwise addition of 252 g of hexamethylene diisocyanate, the mixture is stirred at 70° C. for 6 h. The polyoxazolane B6 is obtained in the form of a 70% solution after the addition of 113 g of dimethyl diglycol.

B 7) The oxazolane B7 is obtained from 210 g of diethanolamine, 281,6 g of 2-ethylhexanal and 122,9 g of cyclohexane after separation of 35 g of water (theoretical quantity: 36 g).

B 8) 400 g of an aliphatic polyisocyanate containing biuret groups and based on hexamethylene diisocyanate and 397 g of methoxypropyl acetate are introduced into a 2-liter reaction vessel equipped with stirrer, condenser and heating device. After the dropwise addition of 526.1 g of the oxazolane of diethanolamine and 2-ethylhexanal described in B 7), the temperature of the reaction mixture is maintained at 70° C. for 11 h. An approximately 70% solution of B8 containing a statistical average of 3 oxazolane groups is obtained.

B 9)a)296 g of phthalic anhydride, 324 g of cyclohexane dimethanol and 52 g of neopentyl glycol are weighed in a reaction vessel suitable for esterification under a nitrogen atmosphere and heated to 220° C. for 8 h. Water is separated until the acid number has reached or dropped below 2.5. The polyester precursor B9a is obtained.

145,2 g of the polyisocyanate described under the heading of B7 and 113.4 g of methoxypropyl acetate are weighted into a 1-liter reaction vessel equipped with stirrer, condenser and heating device and heated to 60° C. Thereupon 119.5 g of the oxazolane precursor obtained from diethanolamine and 2-ethylhexanal is then added dropwise and stirring is continued at 70° C. for 3 h. After the addition of 318.4 g of polyester precursor B 9 a, the temperature is maintained at 70° C. for 11 h and B9 which is a polyester-based polyoxazolane is then obtained as a 70% solution.

B 10) A polyoxazolane is prepared from 187.8 g of an isocyanurate polyisocyanate, which has been prepared by partial trimerisation of the NCO groups of hexamethylene diisocyanate in accordance with EP 10589 and which has an NCO content of 21.45% by weight, and 1623 g of oxazolane (obtained from 1728 g of methyl ethyl ketone and 2100 g of diethanolamine). The highly viscous product is dissolved in butyl acetate to from a 70% solution. The solution has a viscosity of 900 mPa.s at 23° C.

B 11) A polyoxazolane is prepared from 840 g of hexamethylene diisocyanate and 2360 g of oxazolane B7. The product has a viscosity of 4000 mPa.s at 23° C.

Moisture-curable composition comprising components (A) and (B) as defined above are used as binder in the slipping layer of the dye-donor element according to the present invention in an amount of at least 10% by weight, preferably in an amount from 30 to 100% by weight.

In addition to said moisture-curable composition the slipping layer of the dye-donor element according to the present invention can also contain one or more of the conventional thermoplastic binders for slipping layers such as poly(styrene-co-acrylonitrile), poly(vinylalcohol-co-butyral), poly(vinylalcohol-co-acetal), poly(vinylalcohol-co-benzal), polystyrene, poly(vinylacetate), cellulose nitrate, cellulose acetate propionate, cellulose acetate hydrogen phthalate, cellulose acetate, cellulose acetate butyrate, cellulose triacetate, ethyl cellulose, poly(methylmethacrylate), and copolymers of methylmethacrylate. Poly(styrene-co-acrylonitrile) is preferred.

Further the slipping layer of the dye-donor element according to the present invention comprises a lubricating material such as a surface active agent, a liquid lubricant, a solid lubricant or mixtures thereof. The surface active agents may be any agents known in the art such as carboxylates, sulfonates, phosphates, aliphatic amine salts, aliphatic quaternary ammonium salts, polyoxyethylene alkyl ethers, polyethylene glycol fatty acid esters, fluoroalkyl $C_2$–$C_{20}$ aliphatic acids. Examples of liquid lubricants include silicone oils, synthetic oils, saturated hydrocarbons and glycols. Examples of solid lubricants include various higher alcohols such as stearyl alcohol, fatty acids and fatty acid esters. Preferred lubricants are polysiloxanes or copolymers thereof including functionalized polysiloxanes (such as hydroxy or amino modified polysiloxanes). Particularly preferred lubricants are polysiloxane-polyether copolymers and polytetrafluoroethylene. Suitable lubricants are described in e.g. U.S. Pat. No. 4,753,921, U.S. Pat. No. 4,916,112, U.S. Pat. No. 4,717,711, U.S. Pat. No. 4,717,712, U.S. Pat. No. 4,866,026, U.S. Pat. No. 4,829,050. The amount of lubricant used in the slipping layer depends largely on the type of lubricant, but is generally in the range of from about 0.1 to 50 wt %, preferably 0.5 to 40 wt % of the binder or binder mixture employed.

The slipping layer according to the present invention may contain other additives provided such materials do not inhibit the anti-stick properties of the slipping layer and provided that such materials do not scratch, erode, contaminate or otherwise damage the printhead or harm image quality. Examples of suitable additives are described in EP 389153.

In the preparation of the slipping layer according to the present invention a mixture of components (A) and (B) is made in a water-free organic solvent or solvent mixture and optionally other binder resins and other additives (such as a lubricating agent) are dispersed therein to form a composition ready for coating. The solvent(s) are used in a quantity necessary to obtain the required coating composition viscosity adapted to the applied coating system. The quantity of solvent may be kept fairly small by applying low molecular weight maleic anhydride copolymers.

According to a particular embodiment dispensing with solvent removal after coating, a liquid monomer or mixture of monomers is used that acts as solvent for the applied components (A) and (B). Said monomer or mixture of monomers, which has not to be removed by evaporation, can be polymerised at elevated temperature in the presence of a thermally activatable radical former for addition polymerisation.

The hardening of the binder obtained by reaction of components (A) and (B) proceeds quickly in the presence of atmospheric moisture entering the coating after its application. The hardening may be accelerated by heat e.g. in the temperature range of 40° to 130° C., temperature at which applied solvents are removed by evaporation.

According to a special embodiment said components (A) and (B) are used in combination with reagents that split off water on heating, e.g. in a polycondensation reaction of (poly)carboxylic acids with polyols, e.g. polyester prepolymers having terminal hydroxyl groups, vinyl alcohol copolymers, partially esterified cellulose, and/or polyoxyalkylene compounds, or hygroscopic compounds and/or pigments.

The slipping layer of the dye-donor element may be coated on the support or printed thereon by a printing technique such as a gravure process.

The slipping layer thus formed has a thickness of about 0.1 to 3 μm, preferably 0.3 to 1.5 μm.

Preferably a subbing layer is provided between the support and the slipping layer to promote the adhesion between the support and the slipping layer. As subbing layer any of the subbing layers known in the art for dye-donor elements can be used. Suitable binders that can be used for the subbing layer can be chosen from the classes of polyester resins, polyurethane resins, polyester urethane resins, modified dextrans, modified cellulose, and copolymers comprising recurring units such as i.a. vinylchloride, vinylidenechloride, vinylacetate, acrylonitrile, methacrylate, acrylate, butadiene, and styrene (e.g. poly(vinylidenechloride-co-acrylonitrile). Suitable subbing layers are described in e.g. EP 138483, EP 227090, U.S. Pat. No. 4,567,113, U.S. Pat. No. 4,572,860, U.S. Pat. No. 4,717,711, U.S. Pat. No. 4,559,273, U.S. Pat. No. 4,695,288, U.S. Pat. No. 4,727,057, U.S. Pat. No. 4,737,486, U.S. Pat. No. 4,965,239, U.S. Pat. No. 4,753,921, U.S. Pat. No. 4,895,830, U.S. Pat. No. 4,929,592, U.S. Pat. No. 4,748,150, U.S. Pat. No. 4,965,238 and U.S. Pat. No. 4,965,241. Preferably the subbing layer further comprises an aromatic polyol such as 1,2-dihydroxybenzene as described in EP 433496.

Any dye can be used in the dye layer of the dye-donor element of the present invention provided it is transferable to the dye-receiving layer by the action of heat. Examples of suitable dyes are described in, for example, EP 432829, EP 400706, EP 485665, European Patent Application No. 91200218.5, EP 453020, and the references mentioned therein.

The amount ratio of dye or dye mixture to binder is between 9:1 and 1:3 by weight, preferably between 2:1 and 1:2 by weight.

As polymeric binder for the dye layer the following can be used: cellulose derivatives, such as ethyl cellulose, hydroxyethyl cellulose, ethylhydroxy cellulose, ethylhydroxyethyl cellulose, hydroxypropyl cellulose, methyl cellulose, nitrocellulose, cellulose acetate formate, cellulose acetate hydrogen phthalate, cellulose acetate, cellulose acetate propionate, cellulose acetate butyrate, cellulose acetate pentanoate, cellulose acetate benzoate, cellulose triacetate; vinyl-type resins and derivatives, such as polyvinyl alcohol, polyvinyl acetate, polyvinyl butyral, poly(vinylbutyral-co-vinylacetal-co-vinylalcohol), polyvinyl pyrrolidone, polyvinyl acetoacetal, polyacrylamide; polymers and copolymers derived from acrylates and acrylate derivatives, such as polyacrylic acid, polymethyl methacrylate and styrene-acrylate copolymers; polyester resins; polycarbonates; poly(styrene-co-acrylonitrile); polysulfones; polyphenylene oxide; organosilicones, such as polysiloxanes; epoxy resins and natural resins, such as gum arabic. Preferably cellulose acetate butyrate or poly(styrene-co-acrylonitrile) is used as binder for the dye layer of the present invention.

The dye layer may also contain other additives, such as thermal solvents, stabilizers, curing agents, preservatives, organic or inorganic fine particles, dispersing agents, antistatic agents, defoaming agents, viscosity controlling agents, etc., these and other ingredients being described more fully in EP 133011, EP 133012, EP 111004 and EP 279467.

Any material can be used as the support for the dye-donor element provided it is dimensionally stable and capable of withstanding the temperatures involved, up to about 400° C. over a period of up to 20 msec, and is yet thin enough to transmit heat applied on one side through to the dye on the other side to effect transfer to the receiver sheet within such short periods, typically from 1 to 10 msec. Such material include polyesters such as polyethylene terephthalate, polyamides, polyacrylates, polycarbonates, cellulose esters, fluorinated polymers, polyethers, polyacetals, polyolefins, polyimides, glassine paper and condenser paper. Preference is given to a support comprising polyethylene terephthalate. In general, the support has a thickness of 2 to 30 μm. The support may also be coated with an adhesive or subbing layer, if desired. Examples of suitable subbing layers are described, for example, in EP 433496, EP 311841, EP 268179, U.S. Pat. No. 4,727,057, U.S. Pat. No. 4,695,288.

A dye-barrier layer comprising a hydrophilic polymer may also be employed in the dye-donor element between its support and the dye layer to improve the dye transfer densities by preventing wrong-way transfer of dye towards the support. The dye barrier layer may contain any hydrophilic material which is useful for the intended purpose. In general, good results have been obtained with gelatin, polyacryl amide, polyisopropyl acrylamide, butyl methacrylate grafted gelatin, ethyl methacrylate grafted gelatin, ethyl acrylate grafted gelatin, cellulose monoacetate, methyl cellulose, polyvinyl alcohol, polyethene imine, polyacrylic acid, a mixture of polyvinyl alcohol and polyvinyl acetate, a mixture of polyvinyl alcohol and polyacrylic acid or a mixture of cellulose monoacetate and polyacrylic acid. Suitable dye barrier layers have been described in e.g. EP 227091 and EP 228065. Certain hydrophilic polymers, for example those described in EP 227091, also have an adequate adhesion to the support and the dye layer, thus eliminating the need for a separate adhesive or subbing layer. These particular hydrophilic polymers used in a single layer in the donor element thus perform a dual function, hence are referred to as dye-barrier/-subbing layers.

The support for the receiver sheet that is used with the dye-donor element may be a transparant film of e.g. polyethylene terephthalate, a polyether sulfone, a polyimide, a cellulose ester or a polyvinyl alcohol-co-acetal. The support may also be a reflective one such as barytacoated paper, polyethylene-coated paper or white polyester i.e. white-pigmented polyester. Blue-colored polyethylene terephthalate film can also be used as support.

To avoid poor adsorption of the transferred dye to the support of the receiver sheet this support must be coated with a special surface, a dye-image-receiving layer, into which the dye can diffuse more readily. The dye-image-receiving layer may comprise, for example, a polycarbonate, a polyurethane, a polyester, a polyamide, polyvinyl chloride, poly(styrene-co-acrylonitrile), polycaprolactone or mixtures thereof. Suitable dye-receiving layers have been described in e.g. EP 133011. EP 133012, EP 144247, EP 227094, EP 228066. The dye-image-receiving layer may also comprise a cured binder such as the heat-cured product of poly(vinylchloride-co-vinylacetate-co-vinylalcohol) and polyisocyanate.

In order to improve the light resistance and other stabilities of recorded images, UV absorbers, singlet oxygen quenchers such as HALS-compounds (Hindered Amine Light Stabilizers) and/or antioxidants may be incorporated into the receiving layer.

The dye layer of the dye-donor element or the dye-image-receiving layer of the receiver sheet may also contain a releasing agent that aids in separating the dye-donor element from the dye-receiving element after transfer. The releasing agents can also be applied in a separate layer on at least part of the dye layer or of the receiving layer. For the releasing agent solid waxes, fluorine- or phosphate-containing surfactants and silicone oils are used. Suitable releasing agents are described in e.g. EP 133012, JP 85/19138, EP 227092.

The thermal dye sublimation transfer printing process comprises placing the dye layer of the donor element in face-to-face relation with the dye-receiving layer of the receiver sheet and imagewise heating from the back of the donor element. The transfer of the dye is accomplished by heating for about several milliseconds at a temperature of about 400° C.

When the process is performed for but one single color, a monochrome dye transfer image is obtained. A multicolor image can be obtained by using a donor element containing three or more primary color dyes and sequentially performing the process steps described above for each color. The above sandwich of donor element and receiver sheet is formed on three occasions during the time when heat is applied by the thermal printing head. After the first dye has been transferred, the elements are peeled apart. A second dye-donor element (or another area of the donor element with a different dye area) is then brought in register with the dye-receiving element and the process repeated. The third color and optionally further colors are obtained in the same manner.

In addition to thermal heads, laser light, infrared flash or heated pens can be used as the heat source for supplying heat energy. Thermal printing heads that can be used to transfer dye from the dye-donor elements of the present invention to a receiver sheet are commercially available. In case laser light is used, the dye layer or another layer of the dye donor-element has to contain a compound that absorbs the light emitted by the laser and converts it into heat, e.g. carbon black.

Alternatively, the support of the dye-donor element may be an electrically resistive ribbon consisting of, for example, a multi-layer structure of a carbon loaded polycarbonate coated with a thin aluminum film. Current is injected into the resistive ribbon by electrically addressing a print head electrode resulting in highly localized heating of the ribbon beneath the relevant electrode. The fact that in this case the heat is generated directly in the resistive ribbon and that it is thus the ribbon that gets hot leads to an inherent advantage in printing speed using the resistive ribbon/electrode head technology compared to the thermal head technology where the various elements of the thermal head get hot and must cool down before the head can move to the next printing position.

The following examples are provided to illustrate the invention in more detail without limiting, however, the scope thereof.

EXAMPLES

A dye-donor element for use according to thermal dye sublimation transfer was prepared as follows:

A 6 μm thick polyethylene terephthalate film, provided with a conventional subbing layer, was coated with a solution in methylethylketone comprising the ingredients as indicated in table 2 below for forming the slipping layer (wet layer thickness 10 μm). The layer was subsequently heated for 30 minutes at 90° C.

A solution comprising 5 wt % of dye A, 3 wt % of dye B, 2.5 wt % of dye C, 2.5 wt % of biphenylcarbonate as thermal solvent and 6 wt % of poly(styrene-co-acrylonitrile) as binder in methylethylketone as solvent was prepared. From this solution a layer having a wet thickness of 10 μm was coated on the other side of the polyethylene terephthalate film, optionally first provided with a conventional subbing layer. The resulting layer was dried by evaporation of the solvent.

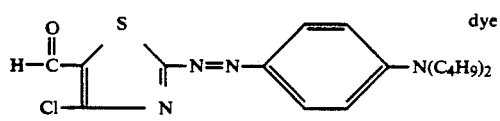

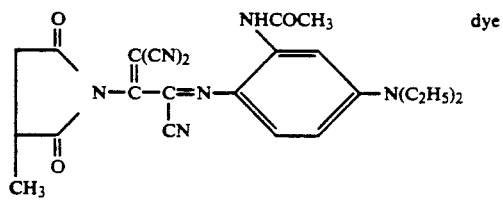

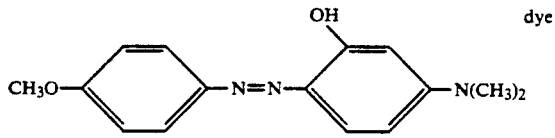

A receiving element for use according to thermal dye sublimation transfer was prepared as follows:

A receiving layer containing 7.2 g/m$^2$ poly(vinylchloride-co-vinylacetate-co-vinylalcohol) (VINYLITE VAGD supplied by Union Carbide), 0.72 g/m$^2$ diisocyanate (DESMODUR VL supplied by Bayer AG) and 0.2 g/m$^2$ hydroxy modified polydimethylsiloxane (TEGOMER H SI 2111 supplied by Goldschmidt) was provided on a 175 μm thick polyethylene terephthalate film.

The dye-donor element was printed in combination with the receiving element in a Mitsubishi color video printer CP100E.

The receiver sheet was separated from the dye-donor element and the performance of the slipping layer was evaluated by visually checking the damage to the slipping layer after printing.

Sticking of the slipping layer to the dye layer occurring in the nonprinted donor element in rolled or folded form was checked by storing the donor element in rolled form for 1 hour at 60° C.

This experiment was repeated for each of the dye-donor elements identified in table 2 below. The amounts in table 2 are indicated in % by weight in the coating solution (solvent is added up to 100%).

The results are listed in table 2 below.

TABLE 2

| No. | Slipping layer | Damage | Sticking |
|---|---|---|---|
| 1 | 7.5% A7, 2.5% 88 | No | No |
| 2 | 3.75% A7, 1.25% B8.5% C | No | No |
| Comparative | 10% C, 1% D | Yes | Yes |

C = poly(styrene-co-acrylonitrile) = Luran 388S supplied by BASF
D = polysiloxane-polyether copolymer (as lubricant) = Tegoglide 410 supplied by Goldschmidt

We claim:

1. Dye-donor element for use according to thermal dye sublimation transfer comprising a support having on one side a dye layer and on the other side a slipping layer, characterized in that said slipping layer comprises the cured product of a moisture-curable binder composition prepared by mixing the following components (A) and (B):

(A) 30 to 99 parts by weight of at least one copolymer of olefinically unsaturated compounds having a weight-average molecular weight of at least 1500 and containing intramolecularly bound carboxylic anhydride moieties, with the anhydride equivalent weight of the copolymers being from 196 to 9800, and (B) 1 to 70 parts by weight of an organic compound containing blocked amino groups capable of forming compounds having free primary and/or secondary amino groups upon hydrolysis, wherein the binder composition contains from 0.25 to 10 anhydride moieties for each blocked amino group.

2. Dye-donor element according to claim 1, wherein said component (A) consists essentially of a copolymer of:

a) 3 to 25 parts by weight of maleic anhydride, and b) 75 to 97 parts by weight of at least one copolymerisable monomer selected from the group corresponding to the following general formulae (I), (II) and (III):

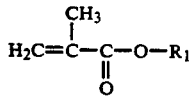

(I)

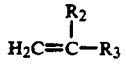

(II)

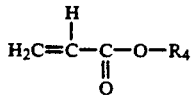

(III)

wherein:

each of $R_1$ and $R_4$ independently of each other represents an aliphatic or cycloaliphatic $C_1$–$C_{22}$ hydrocarbon group in which one or more carbon atoms may be replaced by heteroatoms selected from the group consisting of oxygen, sulphur and nitrogen; a fluoroalkyl group; a perfluoroalkyl group and a polydialkylsiloxane group;

$R_2$ represents hydrogen, methyl, ethyl, chlorine, fluorine or an alkoxy group;

$R_3$ represents a $C_2$–$C_{22}$ aliphatic hydrocarbon group; a $C_5$–$C_{10}$ cycloaliphatic hydrocarbon group; a $C_6$–$C_{12}$ aromatic hydrocarbon group and in each of these three hydrocarbon groups one or more carbon atoms may be replaced by heteroatoms selected from the group consisting of oxygen, sulphur and nitrogen; a fluoroalkyl group; a perfluoroalkyl group; a polydialkylsiloxane group; a nitrile group; chlorine; and wherein component (B) is a compound selected from the group consisting of an aldimine, ketimine, oxazolane, hexahydropyrimidine, tetrahydropyrimidine, tetrahydroimidazole, amidacetale and amidaminale.

3. Dye-done element according to claim 2, wherein said maleic anhydride copolymers (A) have a weight-average molecular weight determined by gel chromatography of 3000 to 50000, and their anhydride equivalent weight is from 3800 to 393.

4. Dye-donor element according to claim 2, wherein said maleic anhydride copolymers (A) contain styrene, methacrylate and/or acrylate units.

5. Dye-donor element according to claim 1, wherein component (B) has a molecular weight of from 86 to 10000 and contains a statistical average of from 1 to 50 structural units corresponding to at least one of the following general formulae (IV), (V), (VI), (VII) and (VIII):

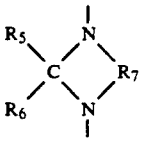

IV

-continued

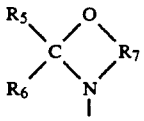

V

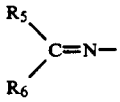

VI

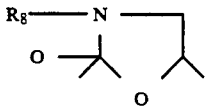

VII

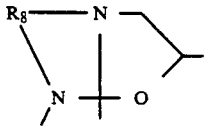

VIII wherein:

each of $R_5$ and $R_6$ independently of each other represents hydrogen, an aliphatic hydrocarbon group containing from 1 to 18 carbon atoms, a cycloaliphatic hydrocarbon group containing from 5 to 10 carbon atoms, an araliphatic hydrocarbon group containing from 7 to 18 carbon atoms or a phenyl group, or $R_5$ and $R_6$ represent together the necessary atoms to form a five- or six-membered cycloaliphatic ring with the carbon atoms being commonly linked;

$R_7$ represents a divalent aliphatic hydrocarbon group containing 2 to 6 carbon atoms, but having only a chain of 2 to 3 carbon atoms between the defined heteroatoms of the ring;

$R_8$ represents a divalent aliphatic hydrocarbon group having 2 to 10 carbon atoms, but having only 2 or 3 carbon atoms between the heteroatoms to which said group is linked.

6. Dye-donor element according to claim 5, wherein component (B) is a polyoxazolane obtained by allowing to react a mono-oxazolane according to said general formula (V) through hydrogen on its nitrogen atom with a polyfunctional reactant selected from the group consisting of a polyisocyanate, polyepoxide, polycarboxylic acid, partially esterified polycarboxylic acid and polyacid anhydride.

7. Dye-donor element according to claim 6, wherein said polyisocyanate is an aliphatic, cycloaliphatic, araliphatic, aromatic or heterocyclic polyisocyanate.

8. Dye-donor element according to claim 1, wherein the amount of said moisture-curable binder in the slipping layer is at least 10% by weight.

9. Dye-donor element according to claim 1, wherein the slipping layer further comprises a polymeric thermoplastic binder.

10. Dye-donor element according to claim 9, wherein said polymeric thermoplastic binder is poly(styrene-co-acrylonitrile).

11. Dye-donor element according to claim 1, wherein the slipping layer further comprises a lubricant.

12. Dye-donor element according to claim 11, wherein the lubricant is a homopolymer or copolymer of siloxane.

* * * * *